US005078089A

United States Patent [19]

Dugan et al.

[11] Patent Number: 5,078,089

[45] Date of Patent: Jan. 7, 1992

[54] OIL SPRAY COATING BOOTH

[75] Inventors: Raymond Dugan; Daniel D. Evans, both of Chesterton; Robert Griffith, Hamlet; Ronald G. Mumaw, Valparaiso, all of Ind.

[73] Assignee: National Steel Corporation, Pittsburgh, Pa.

[21] Appl. No.: 517,744

[22] Filed: May 2, 1990

[51] Int. Cl.[5] ..... B05C 5/00; B05C 11/00; B05C 15/00

[52] U.S. Cl. ..... 118/687; 118/707; 118/316; 118/324; 118/DIG. 7; 160/123; 239/208; 134/183; 52/66

[58] Field of Search ..... 118/663, 668, 676, 687, 118/707, 64, 65, 634, 316, 324, DIG. 7; 52/66, 72; 160/123, 125, 340; 239/208, 209; 134/183, 200

[56] References Cited

U.S. PATENT DOCUMENTS

| | | | |
|---|---|---|---|
| 1,821,694 | 9/1931 | Dennison | 118/DIG. 7 |
| 2,175,259 | 10/1939 | Erickson | 118/DIG. 7 |
| 3,070,064 | 12/1962 | Busse | 118/687 |
| 3,608,252 | 9/1971 | Bisson | 52/66 |
| 3,842,793 | 10/1974 | Novice et al. | 118/4 |
| 4,133,255 | 1/1979 | Guice | 98/115 |
| 4,230,032 | 10/1980 | Perryman | 118/DIG. 7 |
| 4,231,289 | 11/1980 | Domicent | 98/115 |
| 4,664,061 | 5/1987 | Morioka et al. | 118/DIG. 7 |
| 4,672,889 | 6/1987 | Lynch | 52/66 |
| 4,706,420 | 11/1987 | Winkler | 52/66 |

FOREIGN PATENT DOCUMENTS

| | | | |
|---|---|---|---|
| 1269850 | 11/1986 | U.S.S.R. | 118/667 |

*Primary Examiner*—Richard V. Fisher
*Assistant Examiner*—Todd J. Burns
*Attorney, Agent, or Firm*—James L. Bean

[57] ABSTRACT

A spray coating booth for enclosing individual articles to be coated with a liquid spray while the articles are supported in closely spaced relation on an article conveyor for movement through the booth includes a rigid frame with fixed sidewalls and movable top and end walls which may be moved between a closed position completely enclosing an article supported on the conveyor and an open position to permit articles to be moved into and out of the booth. The movable top assures against coating liquid dripping onto and contaminating articles moving on the conveyor which are not to be coated. The end walls are supported for movement in substantially a transverse vertical plane to permit close spacing of articles on the conveyor without contact of the articles by the end walls.

9 Claims, 2 Drawing Sheets

OIL SPRAY COATING BOOTH

BACKGROUND OF THE INVENTION

1. Field of the Invention

This invention relates to enclosures or booths for use in spray coating, and more particularly to an improved enclosure for use in individually spray-coating large articles being conveyed in closely spaced relation on a conveyor.

2. Description of the Prior Art

It is known in the art to coat large articles at a coating station while the articles are supported on a conveyor for movement past the station. For example, in the steel industry, metal strip formed on a rolling mill is wound into large coils which are conveyed from the rolling operation by a chain and pedestal-type conveyor. Such coils are frequently coated with oil to prevent or control corrosion during storage or shipping and this coating is accomplished while the coils are supported on the conveyor pedestals. In the past, it has been the practice to momentarily stop the conveyor and manually coat the coils using a hand manipulated hose and nozzle for "spraying" or flowing the coating oil over the surface of the coil.

The prior art manual coil spraying operation has not been satisfactory for several reasons. For example, in the brief time alloted for coating each coil, it is not always possible to apply the oil uniformly, making it necessary to use an excess of oil which not only adds to the cost of the operation but also results in substantial oil drainage from a coated coil after it is moved from the coating station. Also, use of a hand manipulated nozzle to coat the coils inherently results in oil being sprayed or deflected onto adjacent equipment as well as onto the floor at and around the coating station, thereby producing a serious safety hazard. Further, because of the end use or the nature of the individual coils, it is frequently necessary or desirable to avoid application of oil to specific coils moving on the conveyor, and the open air manual coil coating operation frequently results in oil contamination of such coils, particularly when large coils are positioned in closely spaced relation on the conveyor.

It is known to provide a coating hood along a conveyor line for containing and removing airborne coating particles and vapors produced by spraying operations within the hood. For example, U.S. Pat. No. 3,842,793 discloses a system for coating glass bottles within a hood as the bottles are moved through the hood on a conveyor. The hood disclosed in this patent is supported for vertical movement out of the path of the conveyed bottles in the event of a log jam. Such hoods conventionally are open ended, forming a tunnel through which the articles to be coated pass in an atmosphere containing the coating material or a spray of the coating material, with the hood being continuously evacuated to prevent escape of the coating material into the environment.

Coating booths are also known in which doors are provided to completely enclose articles being coated. For example, U.S. Pat. Nos. 4,133,255 and 4,231,289 disclose booths for use in spray coating automobiles, with each booth having a door at its end which may be opened to permit a vehicle to be driven into the booth, then closed for the spraying operation. Means for continuously circulating atmosphere through the booth for removing paint vapors and particles is provided. A flexible, roll-up door or curtain is employed by the paint spray booth of the '289 patent.

The manual oil coating of steel coils normally involves application of the oil by a low pressure spraying or flooding process from nozzles designed to cover a relatively large area rather than an atomizing or misting spray of the type conventionally employed in paint booths or the like. While such an operation may result in droplets of oil being projected or deflected from the target coil to thereby contaminate the surrounding area, the relatively heavy oils used generally settle quickly and do not present an environmental hazard in the atmosphere. Thus, it has not been considered necessary to provide an evacuated enclosure and sophisticated precipitation or filtering devices for removing droplets and vapors of such oils from the atmosphere. Nevertheless, droplets of oil do tend to accumulate on surrounding structure and floor areas and it is therefore desirable to contain the oil spray. Use of conventional enclosures, however, present problems in that the oil accumulation tends to run or drop from the overhead structure to contaminate coils passing therethrough which are not to receive the oil coating. Further, the size of a booth required for enclosing the large coils and the close proximity of the coils to one another on the conveyor makes it impractical to use conventional doors on the booth. For example, swinging doors present a problem in that there is insufficient distance between the coils to permit their operation. Laterally sliding doors can project into corridor space adjacent the conveyor to present an obstruction or hazard to traffic or personnel in this area, while oil from vertically sliding doors can drain onto coils which are not to be oiled as they pass through the booth on the conveyor.

It is therefore an object of the present invention to provide an improved coating system for use in oil coating metal coils which are moved seriatim through the booth on a conveyor.

It is another object to provide such a system including a booth having a movable top wall which may be closed during a spraying operation and opened to permit a coil to be moved into and through the booth without contamination from oil dropping from the top wall.

Another object is to provide such a booth having fixed sidewalls and movable end closures or doors which may be opened and closed without interference from the closely spaced coils on the conveyor.

Another object is to provide such a coating booth which is inexpensive to construct, which requires a minimum of space, and which effectively contains oil from a plurality of spray nozzles located in the booth during spray coating a coil in the booth.

SUMMARY OF THE INVENTION

The foregoing and other objects and advantages are achieved in accordance with the present invention wherein the spray booth includes rigid frame means at a coating station along the coil conveyor path and a pair of fixed oil impervious sidewalls mounted in opposite relation to one another on the frame, one on each side of the conveyor. A movable top wall or roof is mounted for pivotable movement from a closed position extending across the conveyor between the top portion of the sidewalls and an open position projecting upwardly from the sidewalls. Preferably the top wall is in the form of two panels, one mounted for pivotal movement about a horizontal axis at the top of each sidewall, with the two panels cooperating to close the top of the booth in the lowered or closed position. In the closed position, the roof cooperates with the sidewalls to form an open-ended tunnel through which coils moving on the conveyor must pass. Movable end closures are provided at each open end of the tunnel, and actuator means is provided to open and shut the end closures. Preferably the end closures are in the form of collapsible doors or curtains which move substantially in vertical, transverse planes at the ends of the booth to enable the closures to pass between successive, relatively closely spaced coils on the conveyor to open and close the booth.

A plurality of spray nozzles are mounted within the tunnel at fixed locations and a conduit system connects the nozzles to a source of oil under pressure. Power actuated valve means is connected in the conduit system and a valve control system is provided to open and close the valves to apply an oil spray to a coil in the tunnel. The control system includes an interlock with the roof and end closures to prevent opening the valves and supplying oil to the nozzles when the roof or end closures are open. Also, a time delay is provided to prevent opening the roof and end closures, or movement of the conveyor, for a predetermined time after the valve means is closed to permit oil droplets in the air to settle and excess oil on the coil and conveyor to drain into a collection pit beneath the booth.

BRIEF DESCRIPTION OF THE DRAWINGS

The foregoing and other features and advantages of the invention will become apparent from the detailed description contained hereinbelow, taken in conjunction with the drawings, in which.

DESCRIPTION OF THE PREFERRED EMBODIMENT

Figure 1:
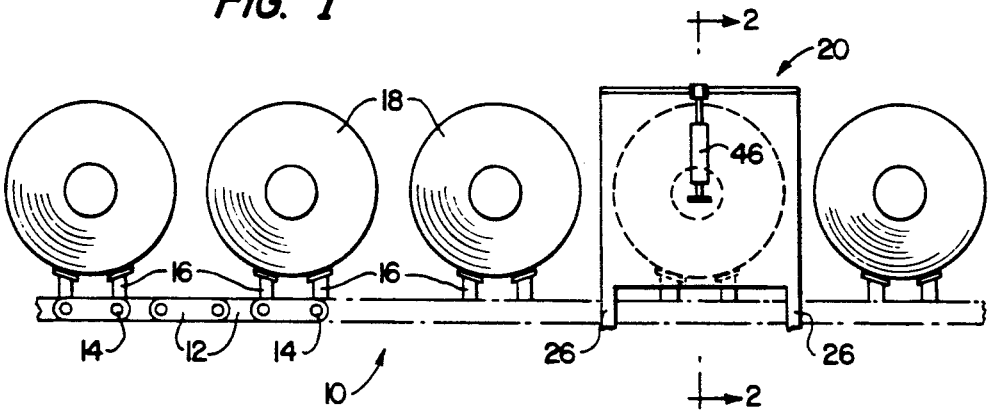
FIG. 1 is a side elevation view of the coil coating apparatus of the present invention in position over a coil conveyor.

Referring now to the drawings in detail, a chain-and-pedestal coil conveyor of the type commonly used in steel mills is generally designated at 10 and includes a series of rigid plate links 12 having their ends connected by transverse rods 14 and supported for movement along fixed tracks by rollers, not shown. Two sets of the plates 12 are supported in laterally spaced relation by the rods 14, with only one set of plates being shown in FIG. 1. Selected ones of the plates, on each laterally spaced set, are provided with upwardly extending rigid pedestals 16, with four pedestals cooperating to provide a cradle for the coils 18. Conveyors of this type are frequently employed to support coils of metal strip for banding and for transfer within the mill from a rolling and coiling operation to loading and storage areas.

In accordance with the present invention, a generally cubic shaped spray coating booth, indicated generally by the reference numeral 20, is positioned along and extends over conveyor 10 at a coating station. The coating booth 20 includes a pair of generally rectangular sidewall assemblies 22, 24 disposed in opposing relation one on each side of and spaced outwardly from the conveyor 10. Side-wall assemblies 22, 24 are substantially identical and each comprises a plurality of vertically extending columns or posts 26 joined at their tops and bottoms by longitudinally extending structural steel frame members 28, 30, respectively. A steel sheet or plate 32 extends over and is rigidly joined, as by welding, to the frame members 26, 28 and 30 to provide rigid fluid-tight side-walls for the booth. The wall assemblies 22, 24 are joined at their top by a pair of transverse structural braces or frame members 34 one at each end of the booth.

The top of the booth is adapted to be closed by a pair of vertically swinging roof panel assemblies 36, 38 mounted for pivotal movement about horizontal axes one at the top of each sidewall assembly 22, 24 as by mounting brackets 40 and pivot pins 42. Roof assemblies 36 and 38 are substantially identical and each includes a rigid metal sheet or plate 43 having a transversely extending beam member 44 rigidly joined, as by welding, to its top surface at substantially its midpoint longitudinally of the booth. The beams 44 each project laterally outboard of the plates 44.

A pair of linear fluid actuators 46 have their cylinder ends mounted, as by brackets 48 and pins 50, one to the outer surface of each sidewall 32 and their rod ends pivotably connected, as by pins 52 to the laterally projecting ends of beams 44. As is apparent from FIGS. 2 and 4, application of fluid pressure to the rod ends of actuators 46 will pivot the doors 36 about pivot pins 42 to move the roof panels from the closed position shown in FIG. 2 to the fully open position shown in FIG. 4. Conversely, fluid pressure applied to the piston end of the actuators 46 will return the roof panels to the closed, horizontal position to cooperate with the sidewall assemblies forming an open ended tunnel straddling the conveyor 10 at the oiling or coating station.

The entrance and exit ends of the tunnel defined by the sidewall assemblies and the roof assemblies are provided with end closures in the form of four substantially identical flexible oil impervious sheets or curtains 54, preferably of a transparent or translucent synthetic resin material. Two of the curtains 54 have their top edges mounted one to each end of the roof panel assembly 36 and the other two similarly are attached to the ends of roof assembly 38. Preferably the curtains 54 are attached to the respective roof assemblies at a location inboard of the transverse beams 34 so that the beams 34 are not wet with oil during the coating operation. When the roof assemblies 36, 38 are in the closed position, the curtains 54 will meet substantially along the longitudinal vertical centerplane of the booth to form an effective barrier to oil being sprayed within the booth. By employing a relatively heavy synthetic resin sheet material, the weight of the material will effectively maintain the curtains in the closed position; however, if desired, weights may be attached to the bottom of the flexible sheets to assure against the curtains being deflected to permit escape of oil spray during the coating operation.

Figure 4:
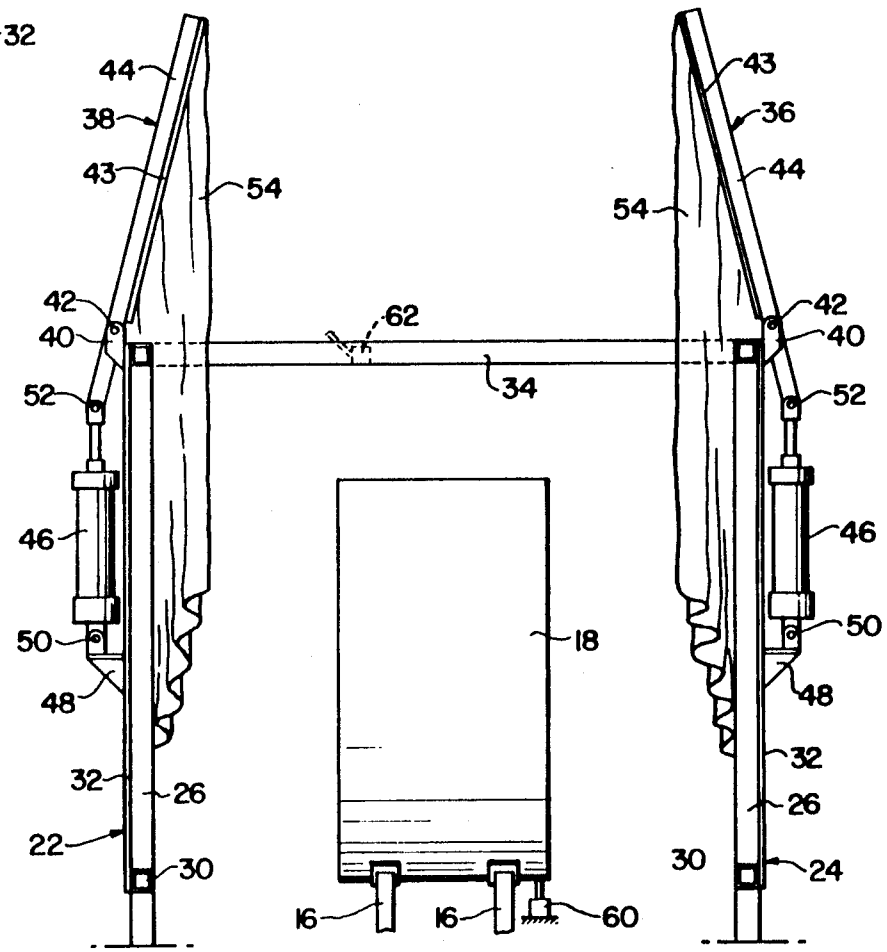
FIG. 4 is a view similar to FIG. 2 but showing the booth in the open condition.
Figure 3:
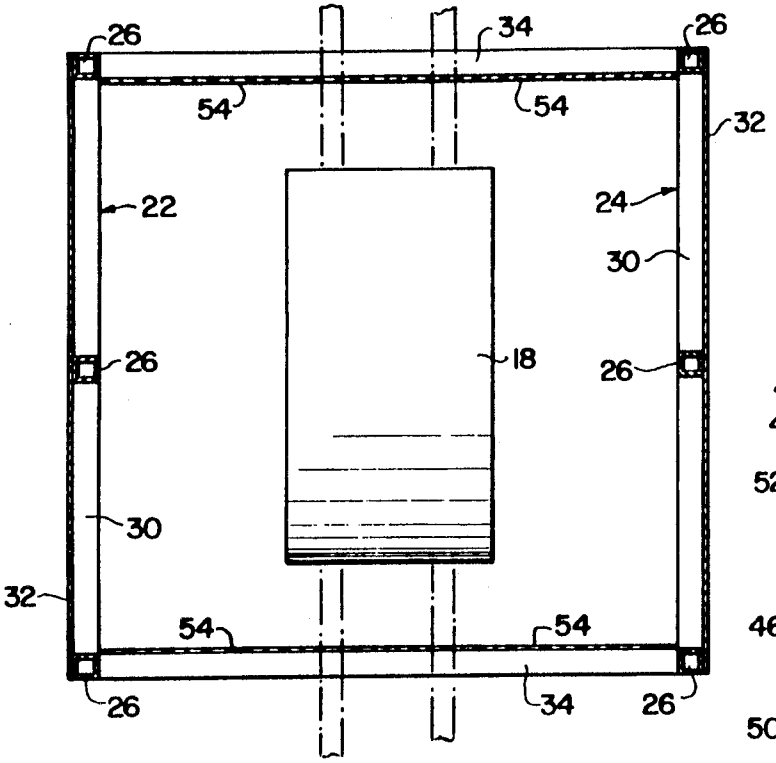
FIG. 3 is a sectional view taken along line 3—3 of FIG. 2.

As best seen in FIG. 4, when the roof assemblies 36, 38 are pivoted to the open position, the flexible curtain panels 54 are collapsed to the side of the coating booth providing substantially unobstructed open ends for the booth. Conversely, when top assemblies 36, 38 are pivoted to the closed position, the curtains expand, substantially in the plane of the open end of the booth, to again simultaneously close both ends of the booth. This arrangement wherein the end closures remain substantially in the vertical end plane of the booth enables successive coils to be positioned on the coil conveyor in relatively closely spaced relation without being contacted and possibly contaminated by the end closure during opening and closing of the booth.

Figure 2:
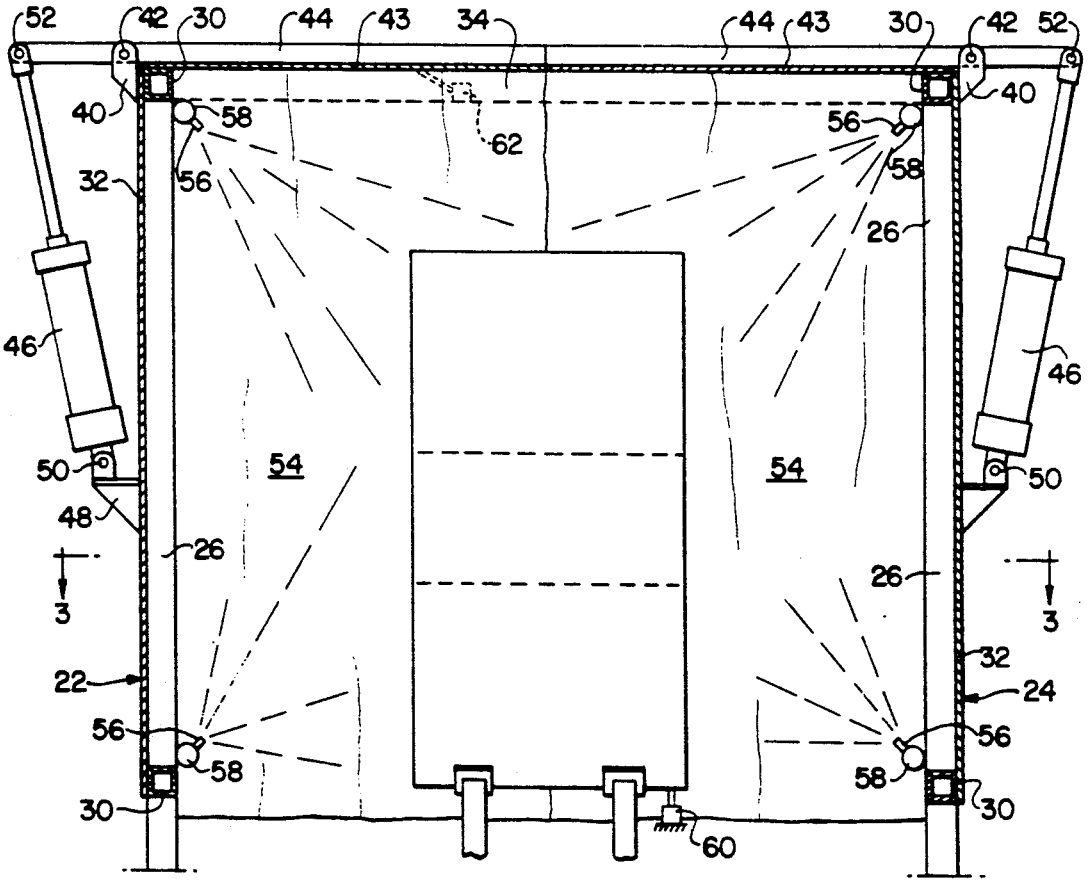
FIG. 2 is an enlarged sectional view taken on line 2—2 of FIG. 1 and showing the booth in the closed condition.

As indicated in FIG. 2, a plurality of oil spray nozzles 56, each connected to an oil supply conduit 58, are positioned at fixed locations within the booth, with the respective nozzles 56 being located to direct a spray of oil at a predetermined area of a coil 18 supported on the pedestals 16 within the booth. The pattern of nozzles within the booth is such that the entire external surface of the coil will be simultaneously coated by the spray discharge regardless of the size of the coil in the booth. By simultaneously discharging an oil spray from all of the nozzles 56, a large coil will be completely coated in a very short time period, thereby saving substantial time over the previously used manual coating procedure.

Operation of the coating booth and spray system may be manually controlled but preferably is electrically or pneumatically controlled for automatic or semi-automatic operation. For example, a limit switch, indicated generally at 60 in FIG. 4 may be mounted within the booth for actuation when a coil is centrally positioned in the booth on the conveyor 10. The switch 60 is connected in a circuit to actuate a valve directing fluid under pressure to the piston end of cylinders 46 to close the roof assemblies 36, 38, thereby automatically closing the end curtains 54 to enclose the coil 18. A second limit switch 62 is mounted in position to be actuated when the roof assemblies 36, 38 are in the closed position, thereby energizing a circuit opening a valve, not shown, connected in the oil conduit system to direct oil, under pressure, to the nozzles 56 and a timer (not shown) closes the valve after a predetermined time. Since end curtains 54 are attached to the roof assemblies 36, 38 at a location inboard of the cross beams 34, these members will not be coated with the oil.

When the pressure oil supply to the nozzles 54 is terminated, preferably a time delay is provided to permit excess oil to drain from the coated coil, conveyor, and the interior of the coating booth into the conventional drainage pit, not shown, provided beneath the conveyor at the coating station. After this time delay, fluid under pressure is directed to the rod end of actuators 46 to pivot the roof assemblies 36, 38 to the fully raised position and to collapse the curtains 54 against the sidewalls of the booth. The conveyor is then energized to advance the coated coil from the booth and to position the next coil within the booth.

If the next coil is to be coated, actuation of the switch 60 again repeats the cycle. However, in the event that a coil 18 is not to be oiled, an override, which may be a preprogrammed or a manually controlled override, is provided to prevent closing of the booth and the coil conveyor can be driven to pass the coil directly through the open booth. Since the roof assemblies and the end closure curtains are moved from the coil's path and since the cross beams 34 are not coated with oil during the previous coating operation, there is no danger of oil dripping from any overhead structure to contaminate a coil which is not to be coated.

While a preferred embodiment of the invention has been disclosed and described, it is apparent that various modifications could be made. For example, various means such as track means and actuators may be provided for independently opening and closing the end curtains. Also, the end closures may be in the form of collapsible or foldable rigid or semi-rigid panel assemblies provided with suitable support and actuator means to open and close the ends of the booth. It is important, however, that the end closures be capable of being opened and closed without requiring excessive floor space and that they be able to move between successive coils on a conveyor without contacting and contaminating the coils. Thus, while a preferred embodiment of the invention has been disclosed and described, it should be understood that the invention is not so limited but rather that it is intended to include all embodiments which would be apparent to one skilled in the art and which come within the spirit and scope of the invention.

What is claimed is:

1. An article coating system comprising a conveyor for conveying articles along a path past a coating station, a coating booth for enclosing individual articles to be coated with a liquid spray while the articles are supported in closely spaced relation on said conveyor for movement along said conveyor path through the booth from an entrance end to an exit end, said booth including frame means at said coating station and extending above said conveyor, a pair of fixed generally vertical sidewalls mounted in opposed relation on said frame one on each side of said conveyor, movable roof means including at least one roof panel mounted for pivotal movement about a horizontal axis extending generally parallel to said conveyor path adjacent the top of at least one of said sidewalls, power means operably connected with said roof means for moving said roof means between a closed position wherein said roof means provides a substantially continuous roof extending above said conveyor between said sidewalls and an open position extending upwardly from said sidewalls and spaced laterally outward from said conveyor path, end closure means mounted at said entrance end and at said exit end of said booth, said closure means being movable between closed position closing said entrance end and said exit end, respectively, of said booth and open positions providing an unobstructed path for articles moving on said conveyor into and out of said booth, power means for moving said end closure means between said open and said closed positions, liquid coating dispensing means including a plurality of coating liquid dispensing nozzles mounted within said booth and conduit means providing coating liquid under pressure to said nozzles, and control means for controlling operation of said liquid coating dispensing means, said control means being operably connected to said roof means and said end closure means to dispense coating liquid only when said roof means and said end closure means are in closed position.

2. The article coating system defined in claim 1 wherein said roof means comprises a pair of generally rectangular panel members mounted one adjacent the top of each said sidewall, said panel members in the closed position cooperating to close the top of the booth.

3. The article coating system defined in claim 1 wherein said power means operably connected with said roof means comprises a pair of fluid cylinders operably connected one between each said sidewall and the roof panel mounted thereon.

4. The article coating system defined in claim 1 wherein said end closure means mounted at said entrance end and said exit end remain substantially in the vertical plane of the entrance end and the exit end, respectively, of said booth during movement between the open and closed positions.

5. The article coating system defined in claim 4 wherein said end closure means comprises flexible curtain means.

6. The article coating system defined in claim 5 wherein said flexible curtain means comprises a pair of curtain panels mounted at said entrance end and a pair of curtain panels mounted at said exit end.

7. The article coating system defined in claim 6 wherein said roof means comprises a pair of generally rectangular roof panel members mounted one adjacent to the top of each of said sidewalls, said roof panel members in the closed position cooperating to close the top of the booth.

8. The article coating system according to claim 7 wherein said power means operably connected with said roof means is operable to move said curtain panels between the open and closed position simultaneously with movement of said roof panel members.

9. The article coating system according to claim 8 wherein curtain panels of each pair of curtain panels are mounted one directly to the end portion of each said roof panel member for movement therewith upon movement of the roof panel members between the open and closed positions.

* * * * *

UNITED STATES PATENT AND TRADEMARK OFFICE

CERTIFICATE OF CORRECTION

PATENT NO. : 5,078,089

DATED : Jan. 7, 1992

INVENTOR(S) : Raymond Dugan et al

It is certified that error appears in the above-identified patent and that said Letters Patent is hereby corrected as shown below:

Column 4, line 2, delete "Side-wall" and insert --Sidewall--.

line 9, delete "side-walls" and insert --sidewalls--.

Column 6, line 43, delete "position" and insert --positions--.

line 58, after "in", insert --the--.

line 66, delete "1" and insert --2--.

Signed and Sealed this

Twentieth Day of April, 1993

*Attest:*

MICHAEL K. KIRK

*Attesting Officer*

*Acting Commissioner of Patents and Trademarks*